US008555446B2

(12) United States Patent
Moes et al.

(10) Patent No.: US 8,555,446 B2
(45) Date of Patent: Oct. 15, 2013

(54) FLUID DISTRIBUTING BRUSH ASSEMBLY AND METHOD FOR OPERATING THE SAME

(75) Inventors: Freddy Moes, Eindhoven (NL); Bastiaan Johannes De Wit, Eindhoven (NL); Peter Christian Eshuis, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 150 days.

(21) Appl. No.: 13/123,652

(22) PCT Filed: Oct. 16, 2009

(86) PCT No.: PCT/IB2009/054552

§ 371 (c)(1), (2), (4) Date: Apr. 11, 2011

(87) PCT Pub. No.: WO2010/044075

PCT Pub. Date: Apr. 22, 2010

(65) Prior Publication Data

US 2011/0191968 A1 Aug. 11, 2011

(30) Foreign Application Priority Data

Oct. 16, 2008 (EP) ..... 08166743

(51) Int. Cl.
*A46B 13/00* (2006.01)

(52) U.S. Cl.
USPC ..... 15/21.1; 15/179; 15/52.1

(58) Field of Classification Search
USPC ..... 15/21.1, 179, 159.1, 49.1, 50.3, 52.1
See application file for complete search history.

(56) References Cited

U.S. PATENT DOCUMENTS

| | | | | |
|---|---|---|---|---|
| 3,939,521 | A | 2/1976 | Clark | |
| 5,416,943 | A * | 5/1995 | Weltikol et al. | 15/49.1 |
| 5,806,126 | A | 9/1998 | De Larios et al. | |
| 6,308,369 | B1 * | 10/2001 | Garcia et al. | 15/230 |
| 2001/0022008 | A1 | 9/2001 | Dickey et al. | |
| 2007/0221248 | A1 | 9/2007 | Boatman | |

FOREIGN PATENT DOCUMENTS

| | | |
|---|---|---|
| DE | 1630527 | 12/1970 |
| FR | 2797895 | 3/2001 |
| JP | 2003299602 A | 10/2003 |
| JP | 2004033570 | 2/2004 |
| WO | 9904669 | 2/1999 |
| WO | 03011169 | 2/2003 |

* cited by examiner

*Primary Examiner* — Shay Karls

(57) ABSTRACT

Disclosed is a brush assembly suitable for use in a wet floor cleaning device. The brush assembly comprises a brush that includes a hollow core. An inner surface of the core is compartmentalized into a number of compartments. An outer surface of the core is furnished with brush material, and the core is pierced with a number of outflow openings. The brush assembly further comprises a first fluid injector for injecting a fluid into the core, and a drive mechanism configured for rotating the brush around an axis. Also disclosed is a method for operating the brush assembly.

10 Claims, 6 Drawing Sheets

FLUID DISTRIBUTING BRUSH ASSEMBLY AND METHOD FOR OPERATING THE SAME

TECHNICAL FIELD

The present invention relates to a fluid distributing brush assembly suitable for use in a cleaning apparatus, e.g. a floor cleaning apparatus.

BACKGROUND

A cleaning apparatus may comprise a rotatable brush that, when brought into contact with a surface to be cleaned and rotated, will perform a scrubbing action. To enhance the working of the apparatus, the surface may be wetted.

FR 2,797,895, for example, discloses a rotatable brush assembly for use in a street cleaning device. The brush assembly has a hollow support shaft, formed by a hollow cylinder. One end of the cylinder is closed, whereas another end may be connected to a water feed. The cylindrical wall of the shaft is provided with multiple rows of bristles, and has multiple openings arranged there between through which water, which may be fed into the hollow cylinder via the water feed, may flow outwards. The centrifugal force associated with the rotation of the shaft projects the water onto a surface to be cleaned. There, the water softens the dirt, which may subsequently be removed by the moving bristles.

SUMMARY OF THE INVENTION

In the development of modern wet brush cleaners, it may be desirable to minimize the consumption of water. A cleaning apparatus that spends little water or cleaning solution requires only a relatively small cleaning solution reservoir. Apart from being economical, such a cleaning device would allow for a compact and handy (i.e. ergonomic) design, which may be especially appreciated in domestic use.

However, the less cleaning solution is used, the harder it is to distribute the cleaning solution over the brush's surface according to a desired wetting profile, e.g. a uniform wetting profile. The present invention aims to provide an economical and reliable fluid distributing brush assembly capable of effecting a desired wetting profile across the surface of a rotating brush.

According to one aspect of the invention, a brush assembly suitable for use in a wet floor cleaning device is provided. The brush assembly comprises a brush that includes a hollow core. An inner surface of the core is compartmentalized into a number of compartments. An outer surface of the core is furnished with brush material, and the core is pierced with a number of outflow openings. The brush assembly further comprises a first fluid injector for injecting a fluid into the core, and a drive mechanism configured for rotating the brush around an axis.

In short, the operation of such a brush assembly is as follows. As the drive mechanism rotates the brush around the axis, the fluid injector may inject a fluid, e.g. a cleaning solution, into the hollow core. The injected fluid contacts the core, and settles in the compartments provided on the inner surface thereof. The centrifugal force that results from the rotational motion of the brush continually equalizes the fluid level in any given compartment, and ensures that virtually all of the liquid supplied to a compartment is quickly drained there from through one or more outflow openings, into the brush material provided on the outside of the core. The desired wetting profile of the brush can be set easily by choosing the appropriate configuration of compartments and outflow openings. For example, in an advantageous embodiment of the brush assembly, each compartment is provided with one outflow opening, such that the position of the outflow opening determines precisely where liquid is discharged into the brush material, whereas the size of a compartment—in particular the radial angle through which it extends—determines how much liquid is discharged by the compartment relative to the total amount of liquid that is injected into the hollow core.

According to another aspect of the invention a method is provided. The method comprises providing a brush assembly as provided by the invention. The method further comprises rotating the brush around a longitudinal axis thereof, and injecting fluid into the core, such that the injected fluid is collected by the compartments provided on the inner surface of the rotating core, and the centrifugal force associated with the rotation of the core drains the fluid from the compartments, through the outflow openings, into the brush material.

While the specification concludes with claims that particularly point out and distinctly claim the present invention, it is believed that the present invention will be more fully understood from the following description of certain embodiments, taken in conjunction with the accompanying drawings, which are meant to illustrate and not to limit the invention.

DE 16 30 527 A1 discloses a washing device for vehicles. The device has a stationary shaft around which a hollow roller is rotationally arranged. The roller is provided with brushes. Both the shaft and the roller are provided with openings 3 and 5 for passing through a washing fluid. The inside of the roller is provided with guiding ribs.

WO 99/04669 A discloses a cleaning head having a head member with a lower surface which is adapted to support cleaning means for contact with a surface to be cleaned. The head member has an upper surface, a plurality of openings provided in the head member so that cleaning fluid applied to the upper surface can pass through the openings to the lower surface and into contact with the cleaning means, and fluid deflectors provided adjacent the openings to force cleaning fluid to pass through the openings as the cleaning head rotates.

U.S. Pat. No. 3,939,521 discloses a rotary brush construction including elongate bristles carried on a perforate hollow cylindrical core. Collar units secure the core on a shaft for rotation therewith and are spaced along the inside of the core. Lubricant liquid streams enter the opposite core ends and pass inward through the collars. The liquid passes out through core perforations to lubricate the bristles.

JP 2003 299602 A discloses a floor brush. Washing water is supplied to an upper part of the brush during rotation thereof. The device has a groove for receiving water. The groove has a vertical face. In the vertical face lateral holes are formed. The lateral holes each have a tip which is formed with a vertical pipe communicating with the tip of the brush.

DETAILED DESCRIPTION

Figure 1:
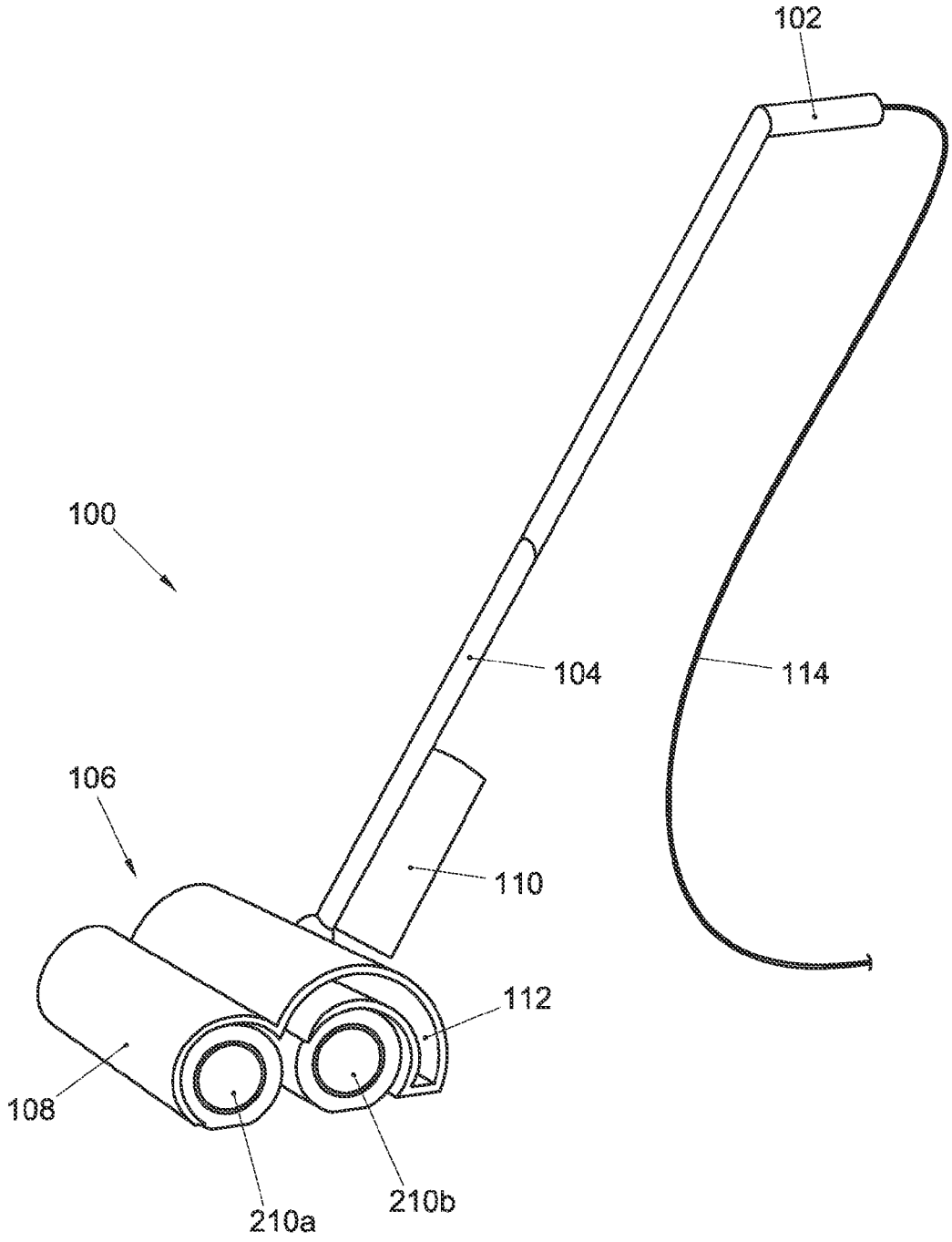
FIG. 1 is a perspective view of an exemplary wet floor cleaning device in which a brush assembly according to the present invention may be used.

In the drawings, identical reference numbers identify the same or similar elements or acts. Shapes, sizes, angles and relative positions of elements in the drawings may not be drawn to scale, and may be arbitrarily enlarged and positioned to improve drawing legibility.

FIG. 1 is a perspective view of an exemplary domestic floor cleaning device 100 in which a fluid distributing brush assembly according to the present invention may be used. The device 100 includes a handle 102, which is connected to a housing 106 via a connection rod 104. The housing 106 accommodates a brush assembly that, in this particular example, comprises two brushes 210*a*, 210*b*. The housing also includes a splashboard 108 that roofs the brushes from the floor up. A power cord 114 is connected to the handle 102 for supplying electrical power from the mains to a drive mechanism of the brush assembly. Cleaning solution may be supplied to the brush assembly from a cleaning solution reservoir 110 that is attached to the connection rod 104. In use, the brushes 210*a*, 210*b* preferably operate in opposite directions. In the view of FIG. 1, this amounts to a counter clockwise and clockwise rotation for the brushes 210*a* and 210*b* respectively. The brushes 210*a*, 210*b*, one or both of which is/are wetted from the inside out, scrub the floor surface on which they rest. In addition, they will effect an upwardly directed air flow between them carrying dirt particles scrubbed off the floor. The air flow may be deflected by the splashboard 108 towards a waste reservoir 112, in which the dirt particles may be deposited.

It is understood that FIG. 1 merely intends to provide the reader with an example of cleaning apparatus 100 in combination with which the brush assembly according to the invention may be used. Below, the brush assembly will be described in more detail without reference to any specific host device.

Figure 2:
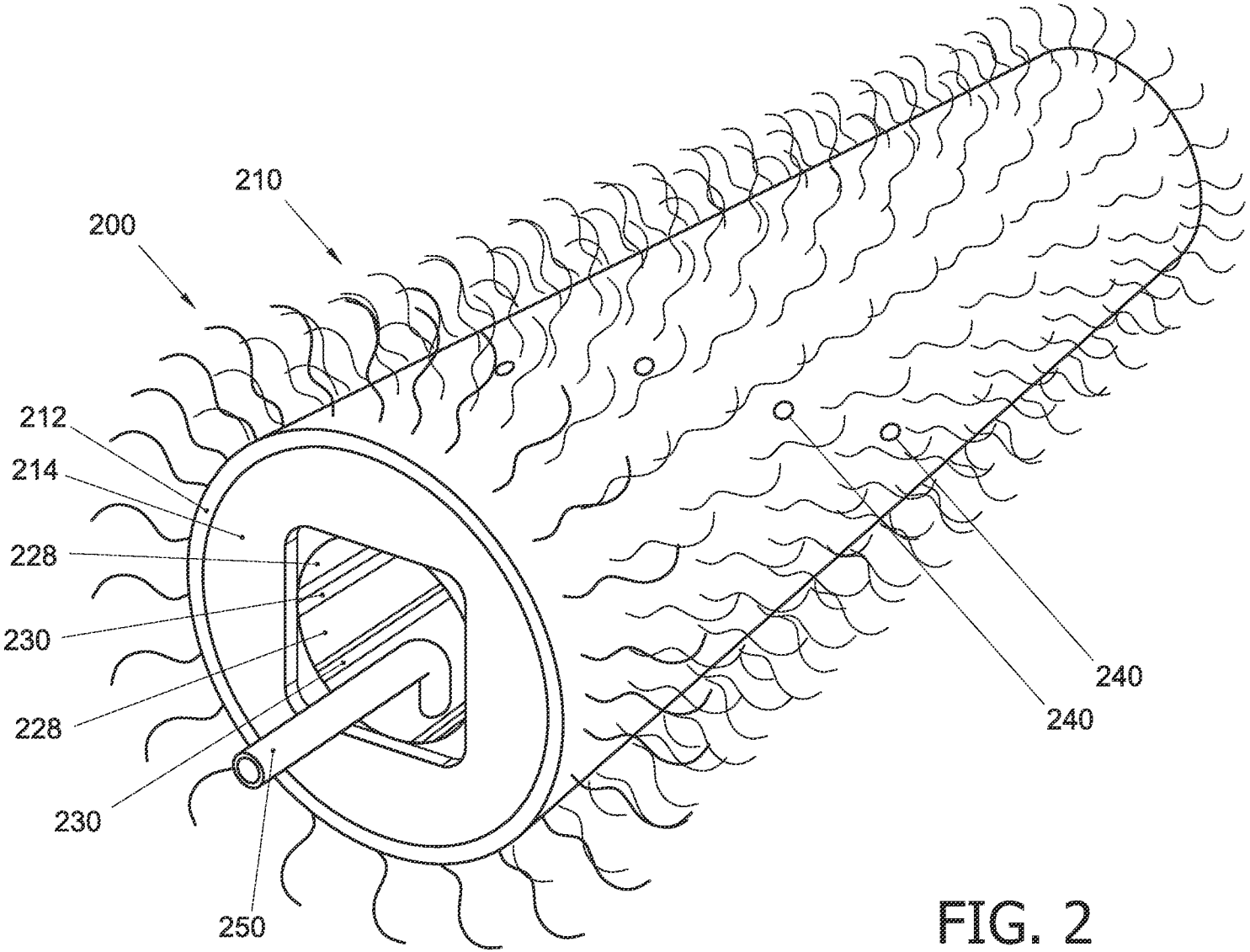
FIG. 2 is a perspective view of an exemplary brush assembly according to the present invention.
Figure 3:
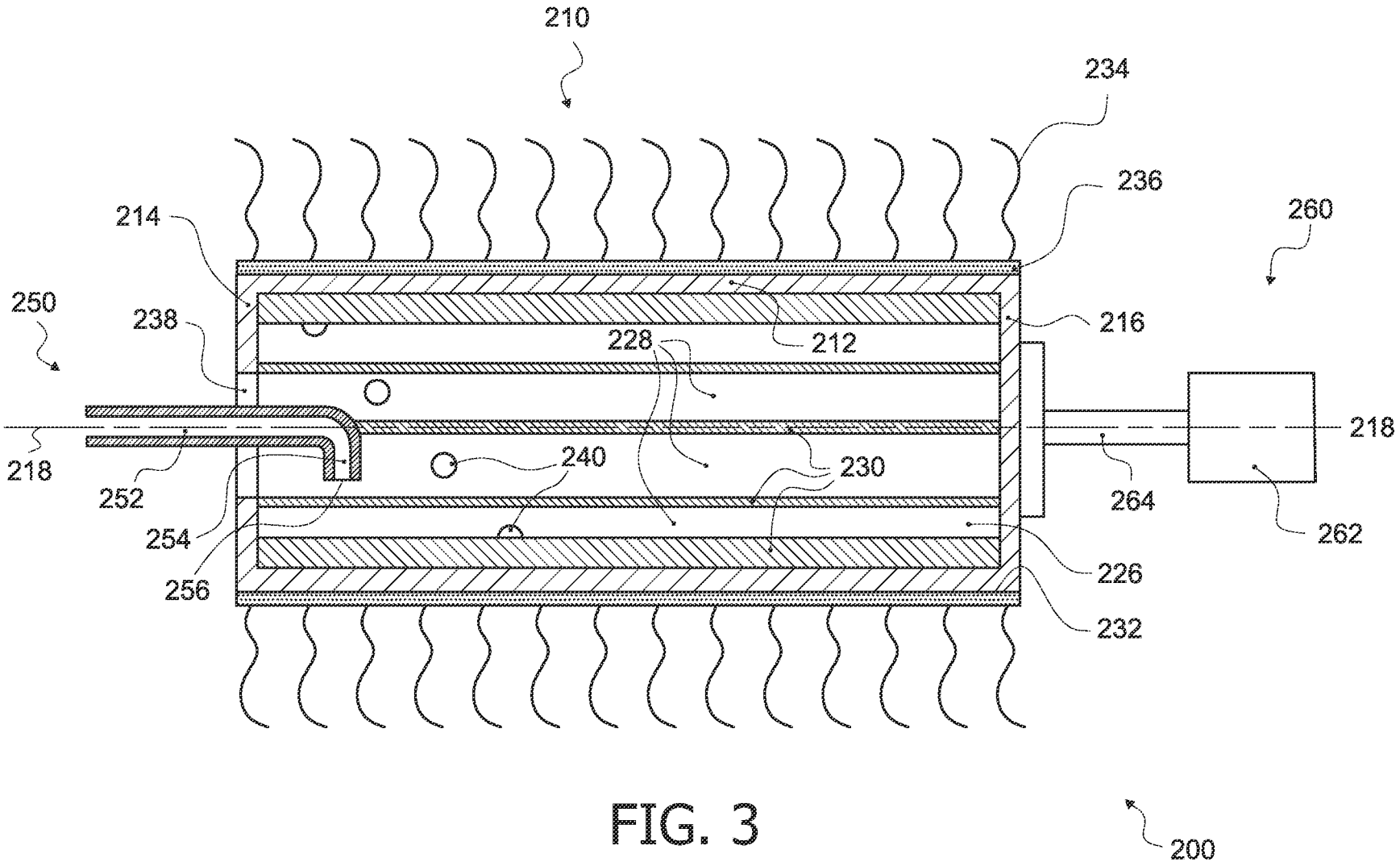
FIG. 3 is a cross-sectional view of the exemplary brush assembly shown in FIG. 2.

FIG. 2 and FIG. 3 illustrate an exemplary brush assembly 200 according to the present invention. FIG. 2 shows a perspective view of the brush assembly 200, while FIG. 3 depicts a cross-sectional view thereof. The brush assembly 200 comprises a brush 210, a fluid injector 250 and a drive mechanism 260.

The brush 210 includes a hollow cylinder jacket shaped core 212 having a longitudinal axis 218. An inner surface 226 of the core is subdivided into elongated compartments 228, which extend along the longitudinal axis 218, from a first end wall 214 to a second end wall 216 of the core. In between the first and second end wall, the compartments 228 are separated from each other by ridges 230 that protrude from the inner surface 226. The inner surface 226 of the core 212 is preferably smooth and even, so as to enable the smooth flow of fluid across the inner surface, within the confines of the compartments 228. Accordingly, dents in inner surface 226 of the core 212 due to for example material shrinkage during injection moulding, and inward buns around the edges of outflow openings 240 as a consequence of punching them, are preferably avoided. Although the core 212 may in principle have any desired shape, cylindrical and prismatic cores are favorable as they can be manufactured easily and economically, for example through extrusion.

The core 212 is provided with a number of outflow openings 240 that pierce its inner and outer surfaces 226, 232. Each compartment 228 may be associated with at least one outflow opening 240, which allows the compartment to be drained. Compartments without a single outflow opening 240 may fill up with fluid during use, and overflow. Although a compartment 228 may be associated with multiple outflow openings 240, one outflow opening may suffice in many practical embodiments. A single outflow opening 240 ensures that all liquid collected by a compartment 228 is drained through that outflow opening. With a compartment 228 having multiple outflow openings 240, the amount of liquid forced out through the different outflow openings may differ slightly, due to, inter alia, the geometry of the compartment. Though this is not necessarily a problem, it may be a factor to be reckoned with when a specific outflow distribution/wetting profile is sought.

Figure 4A:
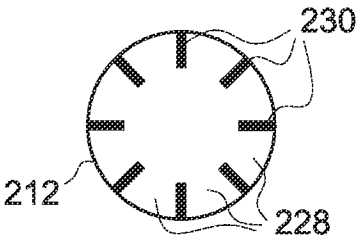
FIGS. 4A-C show a number of exemplary cross-sectional core profiles.
Figure 4B:
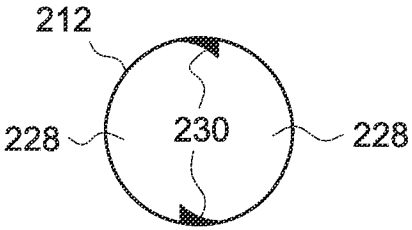
Figure 4C:
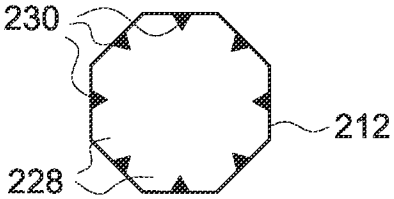

For clarity, FIG. 4A illustrates the cross-sectional profile of the cylindrical core 212 shown in FIG. 2 and FIG. 3. FIGS. 4B and 4C additionally show two cross-sectional profiles of alternative core embodiments. The three cross-sectional profiles all exhibit n-fold rotational symmetry, n being the number of compartments 228 present on the inner surface 226 of the respective core 212. For example, the octagonal cross-section shown in FIG. 4C, which corresponds to an exemplary prismatic core 212, defines eight compartments 228 and has 8-fold rotational symmetry. That is to say, rotating the cross-section around its center by 360/8=45 degrees yields the same octagon. Cores 212 with cross-sections having rotational symmetry, in particular n-fold rotational symmetry, are especially advantageous when a brush 210 with a uniform wetting profile is desired. This is because all compartments 228 are naturally identical, and the uniform wetting profile can easily be set by axially equidistant outflow openings 240, one for each compartment.

Incidentally, FIG. 4 also illustrates the fact that ridges 230 with varying cross-sectional profiles may be used. The ridges 230 shown in FIGS. 4A, 4B and 4C respectively have a simple rectangular, a shark-fin-like and a triangular cross-sectional profile. In principle, the profile of the ridges 230 may be chosen as desired. It will be clear though, that a cross-sectional core profile having ridges 230 with mutually different shapes does not possess n-fold rotational symmetry. Accordingly, the collection of fluid by the different compartments 228 may be biased, favoring some compartments while putting other at a disadvantage.

It is noted that in an alternative embodiment the compartments may be formed without ridges that protrude from an inner surface of the core, but by a specific inner shape of the core. For example, a core with a triangular or rectangular cross-sectional profile may have compartments in the corners of the profile, while the outflow openings may be positioned in these corners as well (on the intersections of the facets or sides), spaced apart along the length of the core.

Figure 5A:
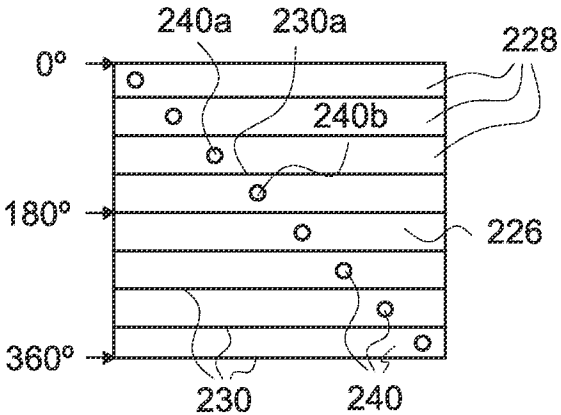
FIGS. 5A-C show a number of plan views of unfolded, inner core surfaces that are consistent with the cross-sectional core profiles shown in FIGS. 4A-C respectively.
Figure 5B:
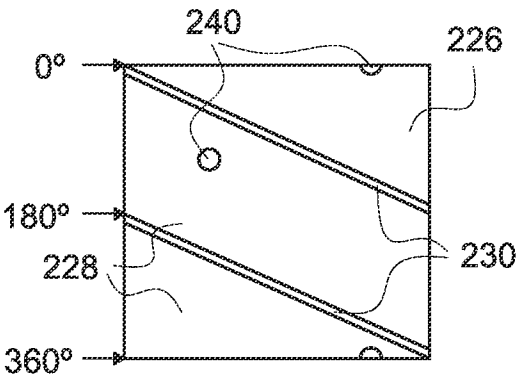
Figure 5C:
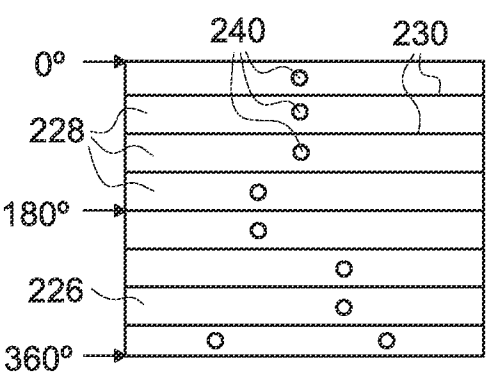

To further clarify the configuration of FIG. 2 and FIG. 3, FIG. 5A illustrates a plan view of an unfolded inner surface 226 of the depicted core 212. The ridges 230 and the compartments 228 clearly extend in parallel, and straightly in the axial direction 218. Each compartment 228 is further provided with precisely one outflow opening 240, and the outflow openings are disposed axially equidistantly, covering the entire axial length of the core 212. FIG. 5B and FIG. 5C additionally show two plan views of unfolded inner surfaces of alternative cores that may correspond with the cross-sectional core profiles shown in FIG. 4B and FIG. 4C respectively. FIG. 4B particularly illustrates the orientation of two ridges 230 and two compartments 228 that extend along the longitudinal axis 218 in a spiraling fashion. FIG. 5C illustrates an arrangement of outflow openings 240 that effects a non-uniform, center loaded wetting profile (i.e. a wetting profile wherein the brush 210 is maximally wet near its axial center, and wherein the degree of wetness drops off towards the sides 214, 216 of the brush core).

Although the three embodiments shown in FIG. 4 and FIG. 5 all have identical compartments 228, this is certainly not necessary. In fact, differently sized or shaped compartments may be used purposefully, for example to effect a non-uniform wetting profile. For instance, the core 212 schematically shown in FIG. 4A and FIG. 5A comprises eight compartments 228, all of which extend through a radial arc of 45 degrees. Given a constant rotational speed and a constant fluid injection rate during use, each compartment 228 will collect the same amount of fluid. If, however, ridge 230*a* and outflow opening 240*a* would be removed, a compartment 228 having one outflow opening 240*b* and extending through a radial arc of 90 degrees would be created. This compartment would collect approximately twice the amount of fluid collected by the other compartments, while this double amount of fluid would still be drained through a single outflow opening 240.

It is understood that the embodiments shown in FIG. 4 and FIG. 5 are exemplary, and that one skilled in the art may make a variety of modifications to create a brush core 212 that fits a particular application. Parameters that may be changed are, for example, the cross-sectional profile of the core 212, including the profile of the ridges 230, the number of outflow openings 240 per compartment 228 and their relative positions, and the geometrical shape of the compartments 228.

Referring again to FIG. 2 and FIG. 3 now. An outer surface 232 of the core 212 is furnished with a brush material 234. In the shown embodiment, the brush material 234 comprises soft micro fiber filaments, which are provided on a liquid permeable backing 236 by means of which the brush material 234 is attached, e.g. glued, to the outer surface 232 of the core 212. In general, any kind of brush material 234 may be used, though the material preferably satisfies minimum requirements regarding wear resistance and cleaning performance. In addition, the brush material may preferably be soft such that the brushes are capable of adapting to irregular surfaces, e.g. surfaces having deep-lying seams or small cracks.

The fluid injector 250 may be partially inserted into the core 212 through an opening 238 in the first end wall 214 of the core 212. The fluid injector 250 may comprise a piece of piping, a first part 252 of which may extend along the longitudinal axis 218 of the core 212, while a second part 254 may extend in a direction non-parallel to the axis 218, for example in a direction having a predominant component in a radial direction with respect to that axis. The second part 254 may comprise an orifice 256 through which fluid may be injected into the hollow core 212, for example in the form of a beam of fluid jetting from the orifice 256 in a direction having a predominant component in a radial direction with respect to axis 218. In the embodiment of FIG. 2 and FIG. 3, the second part 254 of the fluid injector 250 accordingly extends in a direction substantially perpendicular to the inner surface 226 of the core 212. An advantage of a beam of fluid having a predominant component in a radial direction with respect to axis 218 is that it may be cut into pieces and distributed over the different compartments easily and in a well controlled fashion, without appreciable irregular spattering. This may be of particular relevance in embodiments/situations wherein the core 212 does not possess n-fold rotational symmetry, wherein the core has a particular configuration that desires well aimed injection (e.g. see FIG. 6, to be discussed hereafter), wherein the speed of rotation is relatively low and/or wherein the rate of fluid supply is relatively large (e.g. see infra the discussion of FIG. 7). In other embodiments/circumstances the orientation of the beam of fluid, i.e. its angle relative to the core 212, may not be very relevant. In use, for example, the core 212 may be rotated at high speed while the injector 250 preferably remains steady. If the compartmentalization of the inner surface 226 is rotationally symmetric such that all ridges 230 and compartments 228 are identical, the compartments will collect an equal supply of fluid irrespective of the angle at which the fluid injector 250 injects fluid into the core 212.

The fluid injector 250 may inject a fluid, e.g. a cleaning solution, in the form of a liquid jet. To supply a liquid jet, the fluid injector 250 may be coupled to a liquid reservoir, possibly through the intermediation of a pump for controlling the pressure and/or the flow rate at which the liquid is supplied. One skilled in the art will appreciate that it is also possible to inject a gas into the hollow core 212. The aforementioned cleaning solution may for example be heated and vaporized upstream of the orifice 256. Once injected, the vapor will fill up the hollow core 212 and condense on the relatively cool inner surface 226 thereof, feeding the compartments 228. It should be mentioned that the vaporization is not needed nor used to achieve the desired wetting profile of the brush; it is merely an option that allows the supply of liquid at high temperatures, at which cleaning may be more effective. The fluid injector 250 may be a multi-channel fluid injector, that allows different fluids to be injected into the core, either simultaneously or consecutively. Such a fluid injector would, for example, allow for wetting of the brush with a fluid of variable composition.

Although the flow rate at which fluid is supplied into the core 212 is preferably approximately constant, it is observed that fluctuations in the flow rate that persist for at least one rotation of the core should have a minimal effect on the wetting profile of the brush 210. This is because all compartments 228 are affected approximately proportionally. And since the core 212 is preferably rotated at high speed, i.e. at 2500 rpm or above, so that a single rotation takes no more than 2.4 ms, the influence of flow rate variations on the wetting profile may generally be neglected. Of course, the absolute degree of wetting of the brush would be affected by flow rate fluctuations.

The drive mechanism 260 may comprise a motor, for example an electromotor 262. It is understood that a drive mechanism may drive a single brush (as shown in FIG. 3) or more than one brush, e.g. through the intermediation of a branching transmission, if so desired. Generally, it is not necessary for each brush of a brush assembly to have its own dedicated drive mechanism, although in some embodiments it may be favorable as it allows for independent control of the different brushes. A drive shaft 264 of the electromotor 262 may be connected to the second end wall 216 of the core, such that a rotational motion of the drive shaft 264 is transferred to the brush 210. The drive mechanism 260 may be capable of driving the brush 120 at rotational speeds of at least 2500 revolutions per minute (rpm), preferably at least 5000 rpm, and more preferably at least 7000 rpm. The greater the rotational speed at which the brush 210 is driven, the greater the centrifugal force experienced by the fluid residing in the compartments 228 on the inner surface 226 of the brush core 212. As the centrifugal force is the driving force behind the drainage of the compartments 228, a greater rotational speed corresponds to a greater capability of draining the compartments to the very last drop, and thus to a greater capability of distributing very low amounts of liquid. It must be stressed, however, that the centrifugal force is present at any (but zero) rotational speed, such that a drive mechanism only capable of rotating a brush at relatively low rotational speeds may suffice for practicing the invention.

Obviously, the centrifugal force experienced by liquid residing on the inner surface 226 of the brush core 212 is also dependent on the inner radius of the core. Given a certain angular velocity, the larger the inner radius of the core 212, the greater the experienced force. For example, a brush core 212 may have an inner diameter of 20 mm. If it is rotated at 8000 rpm, liquid residing on the inner surface of the core will experience a outward acceleration of approximately 14037 $ms^{-2}$, which corresponds to 1431 times the acceleration of gravity. Liquid residing on the inner surface 226 of a brush core 212 having an inner diameter of 40 mm would experience double that acceleration, and hence, double the centrifugal force.

Now that the exemplary brush assembly 200 shown in FIG. 2 and FIG. 3 has been described in detail, its operation will be elucidated. Assume that a continuous jet of cleaning solution leaves the orifice 256 of the fluid injector 250, and that the brush 210 is being rotated at a speed of several thousands of revolutions per minute. The rotation of the core 212 causes the compartments 228 to pass by the orifice 256 successively. During the time interval that a compartment 228 is located beneath the orifice 256, cleaning solution is squirted into the compartment. Although a compartment 228 receives the cleaning solution near the first end wall 214 (due to the location and orientation of the liquid injector 250), it is almost immediately spread out across the inner surface 226 of the compartment 228 as a result of the centrifugal force. The centrifugal force associated with the high speed rotational motion of the core 212 may easily amount to hundreds of times the force of gravity. It not only ensures that the liquid level in each compartment 228 is quickly equalized, but also that the liquid is quickly drained from the compartment through one or more outflow openings 240. Liquid is thus driven from the compartments 228, through the outflow openings 240, into the permeable backing 236 provided at the outside surface 232 of the core 212. From there it progresses through the brush material 234 that contacts the surface or floor being cleaned.

Preferably, the brush assembly 200 is dimensioned such that drainage of a compartment 228 takes place within one rotation of the core 212, or at least such that the establishment of an equilibrium situation, wherein the rate of fluid outflow through the outflow openings 240 matches the rate of fluid injection by the injector 250, is assured. Indeed, if this were not the case, the compartments 228 would eventually fill up and overflow. Proper dimensioning suggests in particular that the outflow openings 240 do not pose a restriction to the outflow of liquid. That is to say, their sizes/diameters preferably serve no dosing function. Dosing may be taken care of by the combined play of fluid injection and compartment configuration. The flow rate at which the fluid injector 250 delivers may determine the absolute amount of fluid dispensed by the brush 210 per unit time, while the compartment configuration may determine what share of that amount of fluid is discharged where into the brush material 234, so as to obtain the desired wetting profile of the brush. Advantageously, the use of relatively large outflow openings 240 also diminishes the risk congestion thereof, and thus adds to the reliability of the brush assembly 200.

Figure 6:
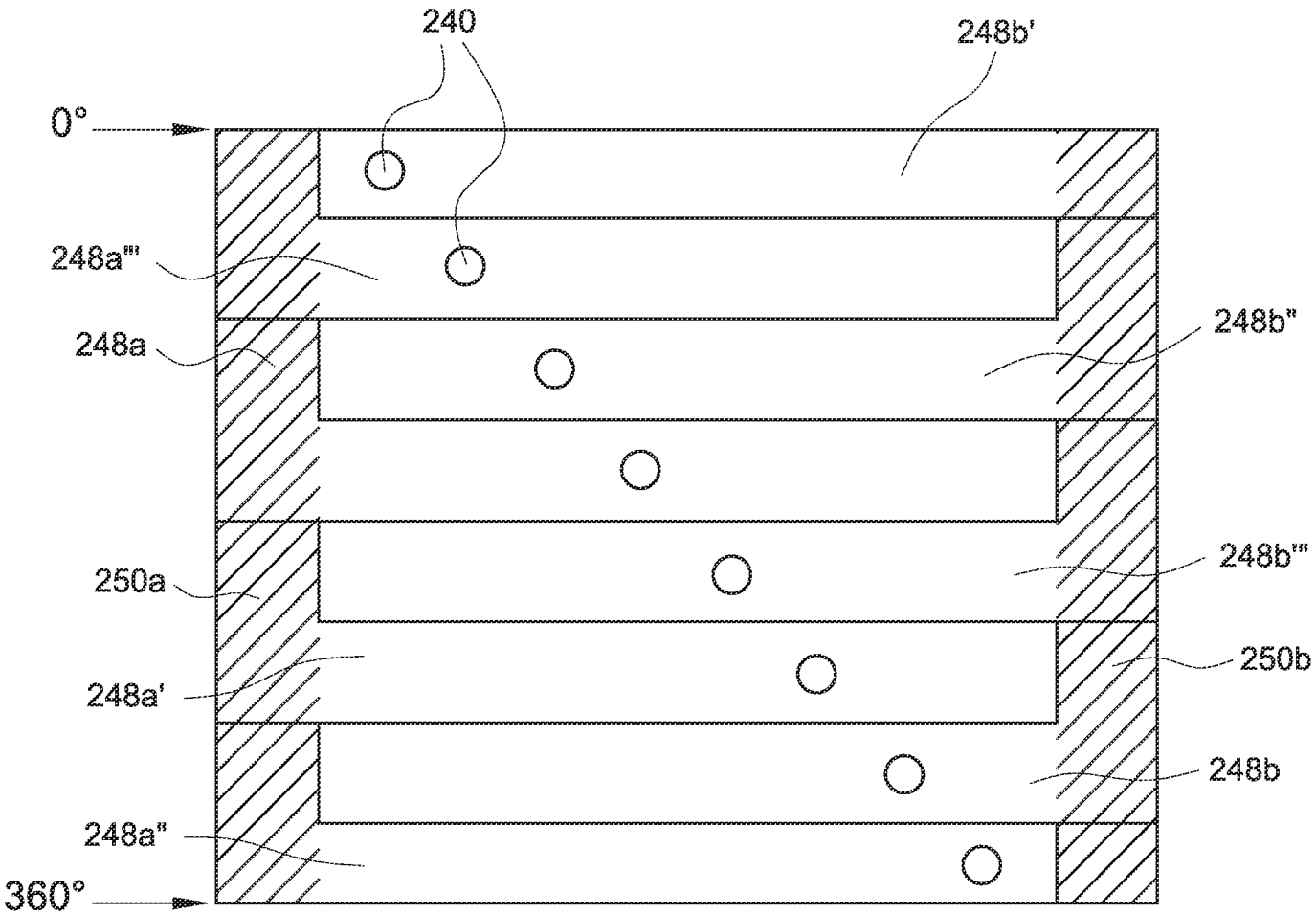
FIG. 6 shows a plan view of an unfolded, inner surface of an exemplary core that comprises a number of compartments which may be exclusively associated with different fluid injectors.

The above-described brush assembly 200 embodiments are configured for wetting a brush according to a certain profile that is based on a single fluid, albeit of a possibly variable composition. However, an embodiment of the brush assembly may be used to effect a wetting profile based on multiple fluids as well. As an example, FIG. 6 shows a plan view of an unfolded inner surface of a core that comprises eight substantially identical, L-shaped compartments 248*a*-248*a*'''', 248*b*-248*b*''''. Compartments 248*a*-248*a*'''' share a lateral zone 250*a* (hatched for clarity) that extends through an angle of 360 degrees. Likewise, compartments 248*b*-248*b*'''' share a lateral zone 250*b* (hatched for clarity) that also extends through an angle of 360 degrees. Each of the compartments 248*a*-248*a*'''', 248*b*-248*b*'''', etc. is provided with an outflow opening 240. It will be clear that when a brush assembly is fitted with two fluid injectors, one of which targets a first liquid at zone 250*a* while another targets a second liquid at zone 250*b*, a wetting profile based on two different liquids may be created.

As described above, high speed rotation of the brush and substantially identical ridges bounding the compartments on the inner surface of the core almost automatically ensure a predictable distribution of injected fluid over the various compartments. However, to maintain this predictability at relatively low rotational speeds an embodiment of the brush assembly may have to meet certain conditions. Such an embodiment will now be described with reference to FIG. 7.

Figure 7:
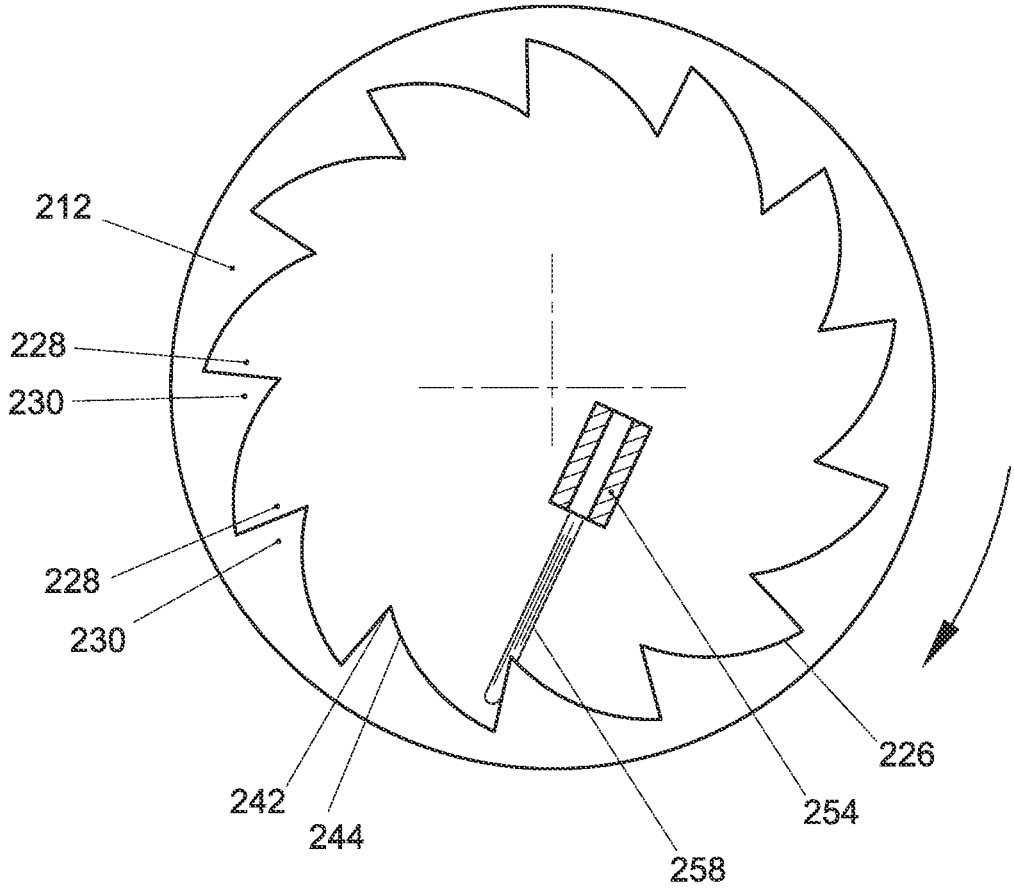
FIG. 7 shows a cross-sectional profile of a core fitted with a number of shark-fin ridges designed to controllably cut off pieces of an injected fluid beam that is injected into the core.

FIG. 7 shows a cross-sectional profile of a core 212, fitted with a number of shark-fin ridges 230. Also shown is an end part 254 of a fluid injector, injecting a fluid beam 258 into the core 212. In the embodiment of FIG. 7, the ridges 230 do not only serve to bound the compartments 228, but also to controllably cut the beam of fluid 258, injected into the core 212 by an end part 254 of a fluid injector, into well defined pieces. A cut off piece of fluid beam 258 is subsequently received in the compartment 228 preceding the respective ridge 230. Ideally, the beam 258 is cut into pieces without generating spatters or droplets of fluid that shoot away in different, uncontrolled directions. The spatters may cause disrupting effects, such as an obstruction of the injected fluid beam 258.

It has been observed that the cutting of the fluid beam 258 occurs neatly without forming spatters or droplets when the following conditions are met: (a) the apex 242 of a ridge 230 is the first part of the ridge to intersect the fluid beam 258, and (b) the trailing, lateral surface 244 of the ridge 230 extends at such an angle with respect to the inner surface 226 of the core 212, that the end of the fluid beam 258 looses contact with this surface 244 as the ridge continues its rotational motion. The former condition—which may be met by appropriately shaping the ridges 230 and/or appropriately directing the beam of fluid 258—ensures a clean cut through the fluid beam. The latter condition—which may be met by appropriately selecting the angle of the trailing, lateral surface 244, the rotational speed of the core 212 and the rate of fluid injection—prevents the accumulation of water on the trailing lateral surface 244 of the ridge 230 and the uncontrollable smearing thereof. Together, the conditions ensure a controlled break down of the fluid beam 258, thereby preventing irregularities in the supply of fluid into the core 212, especially at low rotational speeds and/or conditions of relatively great water supply.

While the invention has been illustrated and described in detail in the drawings and foregoing description, such illustration and description are to be considered illustrative or exemplary and not restrictive; the invention is not limited to the disclosed embodiments. Variations to the disclosed embodiments can be understood and effected by those skilled in the art in practicing the claimed invention, from a study of the drawings, the disclosure, and the appended claims. In the claims, the word 'comprising' does not exclude other elements or steps, and the indefinite article 'a' or 'an' does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A brush assembly suitable for use in a wet floor cleaning device, comprising:

a brush comprising a hollow core, an inner surface of the core being compartmentalized into a number of compartments, an outer surface of the core being furnished with brush material, and the core being pierced with a number of outflow openings;

a first fluid injector for injecting a fluid into the core; and a drive mechanism configured for rotating the brush around a longitudinal axis of the core, wherein, during rotation of the core, the injected fluid is collected by the compartments provided on the inner surface, and the centrifugal force associated with the rotation of the core drains the fluid from the compartments, through the outflow openings, into the brush material wherein said compartments extend along the entire length of a longitudinal axis parallel to the longitudinal axis of the brush assembly from a first end wall of the core to a second end wall of the core.

2. A brush assembly according to claim 1, wherein the core is substantially cylindrical or prismatic.

3. A brush assembly according to claim 1, wherein the compartments are at least partially defined by ridges protruding from the inner surface of the core.

4. A brush assembly according to claim 3, wherein a ridge has an apex, wherein the ridge is shaped and/or wherein the beam of fluid is directed such that—in use—the apex is the first part of the ridge to intersect the fluid beam.

5. A brush assembly according to claims 3, wherein a ridge has a trailing, lateral surface, wherein the trailing, lateral surface extends at such an angle with respect to the inner surface of the core, that in use the end of the fluid beam looses contact with this surface as the ridge continues its rotational motion, which condition may be met by selecting the angle of the trailing, lateral surface, the rotational speed of the core and the rate of fluid injection.

6. A brush assembly according to claim 1, wherein a cross-sectional profile of the core possesses n-fold rotational symmetry with respect to the longitudinal axis of the core, n denoting the number of compartments.

7. A brush assembly according to claim 1, wherein each compartment is associated with at least one outflow opening.

8. A brush assembly according to claim 1, wherein the brush is driveable at a rotational speed of at least 2500 revolutions per minute, whereby the influence of flow rate variations on the wetting profile is neglectable.

9. A wet floor cleaning device comprising a brush assembly according to claim 1.

10. A brush assembly suitable for use in a wet floor cleaning device, comprising:

a brush comprising a hollow core, an inner surface of the core being compartmentalized into a number of compartments, an outer surface of the core being furnished with brush material, and the core being pierced with a number of outflow openings;

a first fluid injector for injecting a fluid into the core; and a drive mechanism configured for rotating the brush around a longitudinal axis of the core, wherein, during rotation of the core, the injected fluid is collected by the compartments provided on the inner surface, and the centrifugal force associated with the rotation of the core drains the fluid from the compartments, through the outflow openings, into the brush material, wherein the first fluid injector and a second fluid injector of the brush assembly are each exclusively associated with one or more compartments, wherein the compartments associated with the first fluid injector share a lateral zone, wherein the compartments associated with the second fluid injector share a further lateral zone, wherein the compartments extend along the entire length of a longitudinal axis parallel to the longitudinal axis of the brush assembly between said lateral zones.

* * * * *